US005690491A

United States Patent [19]

FitzGerald et al.

[11] Patent Number: 5,690,491

[45] Date of Patent: Nov. 25, 1997

[54] METHOD AND APPARATUS FOR SIMULATING THE EFFECTS OF PRECISION-GUIDED MUNITIONS

[75] Inventors: Mark Richard FitzGerald, Phoenix; Joseph Richard Miller, Paradise Valley; Clyde Jack McLennan, Tempe, all of Ariz.

[73] Assignee: Motorola, Inc., Schaumburg, Ill.

[21] Appl. No.: 696,079

[22] Filed: Aug. 13, 1996

[51] Int. Cl.[6] ..... F41A 33/00

[52] U.S. Cl. ..... 434/16; 434/22; 434/11

[58] Field of Search ..... 434/11–17, 19, 434/21, 22

[56] References Cited

U.S. PATENT DOCUMENTS

| | | | |
|---|---|---|---|
| 4,682,953 | 7/1987 | Doerfel et al. | 434/16 |
| 4,729,737 | 3/1988 | Reagan et al. | 434/14 |
| 4,744,761 | 5/1988 | Doerfel et al. | 434/16 |
| 5,228,854 | 7/1993 | Eldridge | 434/11 |
| 5,378,155 | 1/1995 | Eldridge | 434/11 |
| 5,382,958 | 1/1995 | Fitzgerald | 434/16 |

*Primary Examiner*—Richard J. Apley
*Assistant Examiner*—John Muleahy
*Attorney, Agent, or Firm*—Frank J. Bogacz

[57] ABSTRACT

A forward observation officer (21) initiates a call for fire (33) on a particular target (20). The call for fire is received by a control center (30) which generates a precision guided munitions simulation message which is transmitted to all potential targets via a data link (31). The forward observation officer (21) then illuminates the target (20) with a laser designator simulator (22). Laser detectors (23) then determine that the target (20) has been illuminated. Processor arrangement (34) then determines that the target (20) was the correct one that was selected by the forward observation officer (21) and that the location of the precision guided munitions (29) is at the same location of the target (20). Processor arrangement (34) then indicates that the target (20) has been hit or missed.

20 Claims, 2 Drawing Sheets

METHOD AND APPARATUS FOR SIMULATING THE EFFECTS OF PRECISION-GUIDED MUNITIONS

BACKGROUND OF THE INVENTION

The present invention pertains to military training systems and more particularly to realistically simulating precision-guided munitions (PGM).

Techniques exist for simulating area weapons, such as artillery, mortars, and bombs. These systems provide the capability to simulate unguided munitions but do not provide the capability to simulate the new generation of "smart weapons." This class of actual weapons includes laser-guided bombs, guided missiles such as the Hellfire, laser-guided artillery shells like the Copperhead, and laser-guided mortar rounds such as the MORAT.

To date, area weapons effects simulation (AWES) systems have not been able to simulate a single vehicle or other target being designated by a Forward Observation Officer FOO. No existing system currently requires the FOO to actually illuminate the target with a laser designator nor does any system have the capability to tie the PGM casualty assessment to the single target being illuminated by the FOO. The result of these shortcomings is that the FOOs do not receive proper training and the casualties assessed against players are unrealistic for PGM.

It is desirable to provide for simulation of precision-guided munitions firing. An advantage of the present invention is that it provides training for a FOO for simulating laser-designation by the FOO in military training systems.

DESCRIPTION OF THE PREFERRED EMBODIMENT

Figure 1:
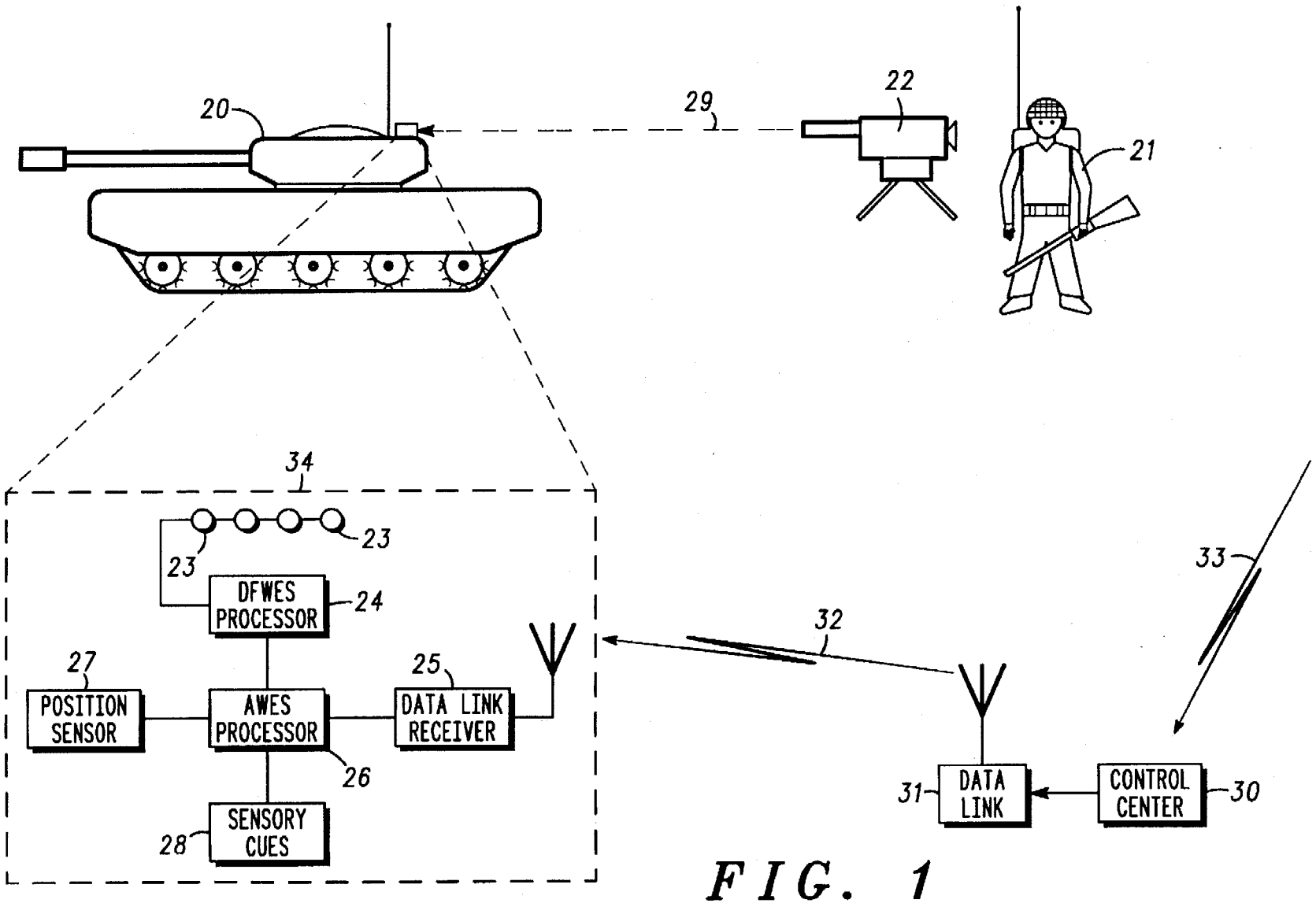
FIG. 1 is a block diagram of an arrangement for simulating precision-guided munitions in accordance with the present invention.

Generally, the present invention provides a method by which precision-guided munitions (PGM) can be realistically simulated during military training exercises.

The method for simulating PGM may be accomplished utilizing the following basic equipment.

A Laser Designator Simulator for Forward Observation Officers or other personnel responsible for designating the targets of PGM. The Laser Designator Simulator may be constructed from existing weapons such as a laser projector from a direct fire simulation system. Such weapons are manufactured by Royal Ordinance, SAAB, and Lockheed-Martin.

A Control Center or other facility for initiating PGM simulations. Such control centers are manufactured by Lockheed-Martin and Cubic.

A Data Link to each player who may be a potential target of PGM to provide information about PGM simulations. This data link may be either one-way or bi-directional. Such data links are manufactured by Motorola.

A Data Link Receiver for each player who may be a potential target of PGM to provide the capability to receive PGM simulation messages. Such data link receivers are manufactured by Motorola.

A Position Sensor for each player who may be a potential target of PGM to provide an indication of the player's position. This may be a Global Positioning System (GPS) receiver, a multilateration-based positioning device, or any similar device capable of determining the player's position. Such position sensors are manufactured by Motorola and others.

One or more Laser Detectors on each player to provide the capability of receiving signals sent from the Laser Designator Simulator. Such laser detectors are manufactured by Royal Ordinance, SAAB, and Lockheed-Martin. This may be provided by existing Direct-Fire Weapons Effects Simulator (DFWES) laser detectors, or may be a dedicated device. Examples of DFWES systems are the BT46 system from Saab Training Systems and the MILES system from Loral Electro Optics Systems.

A DFWES Processor to decode and interpret signals detected by the Laser Detectors. This may be part of an existing DFWES system or may be a dedicated device. Such processors are manufactured by Royal Ordinance, SAAB, and Lockheed-Martin.

An Area Weapons Effects Simulator (AWES) Processor to process PGM information received from the Data Link Receiver, position information from the Position Sensor, and information about detected laser signals from the DFWES Processor. Such processors are manufactured by Motorola. The AWES Processor may be part of an existing AWES System, or it may be common with the DFWES Processor, or may be a dedicated device processing PGM information only. Processor arrangement includes AWES processor 26, DFWES processor 24, position sensor 27, sensory cues 28, data link receiver 25 and laser detectors.

FIG. 1 illustrates a block diagram of a system for implementing PGM simulations in accordance with the preferred embodiment of the present invention. The soldier responsible for designating PGM targets is called the Forward Observation Officer 21. The Forward Observation Officer 21 is equipped with a Laser Designator Simulator 22 which is capable of transmitting a coded laser signal called the Laser Designator Code 29. The Laser Designator Code 29 may be unique to each Laser Designator Simulator 22, or may be a common code which is the same for all Laser Designator Simulators in use.

The Laser Designator Code 29 is detected by one or more Laser Detectors 23 mounted on the targeted player 20, for example tank 20, which convert the laser signals into electrical signals. The Laser Detectors 23 are coupled to a DFWES Processor 24 which receives the electrical signals from the Laser Detectors 23 and decodes the Laser Designator Code.

When the Forward Observation Officer 21 selects a target 20, he sends a call for fire 33 to the Control Center 30. Typically this is done by means of a tactical communication radio link, but this may also be done electronically through an automated fire control system such as the US TACFIRE system or the British BATES system.

Upon receipt of the call for fire 33, the Control Center 30 initiates a Precision-Guided Munitions simulation. This process may be either manual or computer-controlled. The Control Center then sends this information to the players as a PGM Mission Message 32 which is sent via the Data Link 31. This is typically a wireless radio-frequency data link which may be either one-way from the Control Center 30 to the players or a two-way link capable of also sending information from the players to the Control Center. Information in the PGM Mission Message 32 contains the type of weapon being simulated, the location and extent of the possible impact point of the simulated munitions and the Laser Designator Code 29 corresponding to the Laser Designator Simulator 22 being used by the Forward Observation Officer 21 who called for fire. The area and extent of the possible impact point is typically referred to as the "Area of Effects."

The PGM Mission Message 32 is received by a Data Link Receiver 25 mounted on the target player 20 and other similarly equipped players. The Data Link Receiver 25 is coupled to the AWES Processor 26 which interprets the PGM simulation information. The AWES Processor 26 is coupled to a Position Sensor 27 which provides the location of the player to the AWES Processor 26.

The AWES Processor 26 compares the position of the player as given by the Position Sensor 27 to the location of the PGM Area of Effects sent in the PGM Mission Message 32. If within the Area of Effects, the AWES Processor 26 then queries the DFWES Processor 24 to determine whether the player has been lased by the appropriate Laser Designator Simulator 22. If the DFWES Processor 24 indicates that the player had been appropriately lased (illuminated), the AWES Processor 26 then waits an amount of time commensurate with the amount of time in which a real PGM weapon would require a target to be illuminated (lased), then the AWES Processor 26 queries the DFWES Processor 24 again to verify that the player is still being illuminated by the Laser Designator Simulator 22.

After all of the preceding steps have successfully been performed, the player is assessed a "Hit" by the AWES Processor 26 which then activates the appropriate Sensory Cues 28 to enunciate the simulated engagement to the targeted player. These cues may be visual displays, indicator lights, audio alarms, pyrotechnic devices, or any other means of conveying information about the simulated engagement to the player, vehicle crew, soldiers, or other persons in the area.

Figure 2:
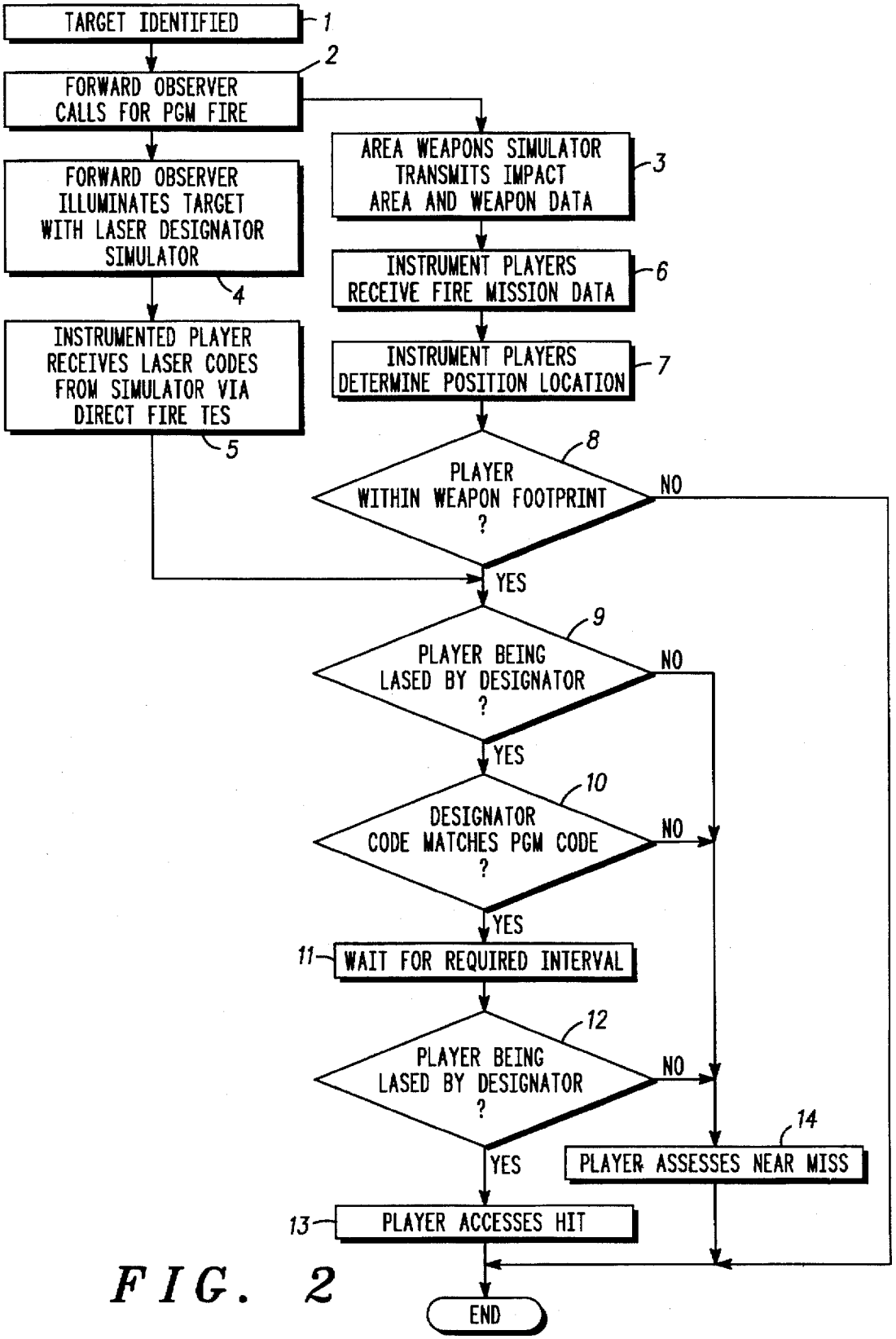
FIG. 2 is a flowchart of a method for simulating precision-guided munitions in accordance with the present invention.

FIG. 2 shows the method for the simulation of PGM in accordance with the preferred embodiment of this invention. This process proceeds as follows.

The forward observation officer (FOO) 21 identifies a target vehicle, block 1.

The FOO 21 calls 33 for a precision-guided munitions (PGM) fire mission, block 2. This may be by voice over his tactical radio or through an automated system such as the American TACFIRE system or the British BATES system.

In response to the FOO's 21 call for fire 33, the Control Center 30 initiates a PGM simulation and transmits pertinent fire mission information message 32 globally to all player units participating in the exercise, block 3. This information includes:

1) Location and extent of the impact area;

2) Type of weapon, munitions, and fuzing; and

3) Laser designator Code 29 of FOO 21.

After the FOO 21 has called for fire, he points his laser-designator simulator 22 at the target vehicle 20 and illuminates (lases) the target, block 4. The FOO 21 must keep the target 20 continually illuminated for the time which would normally be required for the PGM to lock-on to the target 20. The preferred implementation of the laser designator simulator is to use a Direct-Fire Weapons Effects Simulator (DFWES) laser transmitter such as those fixed to soldier's weapons or used as control guns in direct-fire weapons effects systems such as MILES, MILES II, or the Saab BT46 system. A special laser code is used to simulate the laser designator, with the FOO's code implemented as the "shooter identification" number.

The target vehicle player equipment receives and detects the laser signals from the FOO's Laser Designator Simulator 22, block 5. The preferred implementation is to use the laser detectors 23 of the vehicle's DFWES target system to detect the laser transmissions from the FOO 210

All instrumented player units receive the PGM fire mission message 32 from the area weapons simulation system and decode the message, block 6.

After receiving and interpreting the PGM mission data message, the player equipment 34 determines the player's position, block 7. The preferred implementation is to use an on-board Global Positioning System (GPS) receiver, but this can also be done using multilateration or any other positioning determining technique.

The player equipment 34 then compares the player's position to the possible weapon impact area or "Area of Effects", block 8. If the player is within the area, processing continues with block 9. If not, the player equipment 34 ceases to process the mission and the method is ended.

If the player is within the target area, the processor 24 checks to see whether the player is also being illuminated by a laser designator simulator 22, block 9. If the player is within the footprint, processing continues and block 10 is entered. If not, the process jumps to block 14.

If the player is being illuminated (lased), the processor then checks to see if the laser designator code 29 matches that given in the PGM mission message, block 10. If it is, processing continues and block 11 is entered. If not, the process jumps to block 14.

If the designator code matches, the player is the one being illuminated by the FOO 21 and the player unit waits for the required interval to assure that the FOO 21 has kept the target 20 illuminated with the laser designator simulator 22 commensurate with the amount of time a real PGM weapon would require to lock-on to a target, block 11.

After the required time interval, the player equipment 34 again checks to see if the player is still being illuminated, block 12. If it is, the processing continues and block 13 is entered. If not the process jumps to block 14.

If block 13 is entered, the FOO 21 has kept the target 20 illuminated for the required amount of time and the laser designator code matches that for the PGM mission. As a result, the PGM is declared to have impacted the player, in this example tank 20, with a direct hit and appropriate sensory cues are generated to inform the vehicle crew and the FOO 21 of the result.

If the player was in the target area, but was not being illuminated by the proper laser designator code 29, or if the FOO 21 did not keep the laser designator simulator 22 on the target vehicle 20 for the required period of time, the PGM is declared to have near-missed the vehicle, block 14. The vehicle player equipment 34 will activate appropriate sensory cues to inform the vehicle crew and the FOO 21 of the result.

As can be seen for the above description the present invention fulfills the need for training of a forward observation officer for the use of "smart weapons" such as precision guided munitions. This training is extremely valuable since trained officers may be sent into battle in place of inexperienced ones and thereby lead to successful application of "smart weapons" when required. Laser guided training is enabled which training was previously unavailable without trial and error under actual combat circumstances.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. An apparatus for simulating effects of precision guided munitions comprising:

a target;

a designator device for indicating to fire upon said target with said simulated precision guided munitions, said designator device transmitting a signal from said designator device to said target;

a detector for determining that said target has been indicated by said designator device, said detector including a receiver for receiving a mission message indicating that said target is selected for a simulated round of said precision guided munitions; and said detector including a means for determining effects of said simulated round of said precision guided munitions on said target.

2. The apparatus as claimed in claim 1, wherein there is further included:

a control center for receiving a call for fire message from an observer aiming said designator device at said target; and a radio link for transmitting the call for fire message from the observer to said control center.

3. The apparatus as claimed in claim 2, wherein said control center includes a data link for transmitting said mission message.

4. The apparatus as claimed in claim 1, wherein:

said mission message includes a firing location of said simulated round of said precision guided munitions;

said detector includes:

a means for determining whether said target has been indicated with said designator device, said means for determining coupled to said receiver; and a position sensor for independently determining a location of said target, said position sensor coupled to said means for determining; and said means for determining further comparing the location of said target with the firing location of said simulated round of said precision guided munitions.

5. The apparatus as claimed in claim 4, wherein said detector further includes:

detector units for receiving said signal transmitted from said designator device;

means for decoding said signal transmitted from said designator device and received by said detector units, said means for decoding coupled to the detector units and to the means for determining; and said means for determining further comparing said designator code received from said signal with another designator code received by said receiver included in said mission message and signalling if said codes compare.

6. The apparatus as claimed in claim 5, wherein there is further included sensory cues for displaying audio visual effects in response to said means for determining signalling that said designator code and other designator code compare and that said location of said target is within effects of said location of said simulated round of said precision guided munitions, said sensory cues coupled to said means for determining.

7. The apparatus as claimed in claim 5, wherein said means for decoding includes a processor.

8. The apparatus as claimed in claim 5, wherein said detector units include laser detectors.

9. The apparatus as claimed in claim 5, wherein there is further included means for determining an area of vunerability of said target centered around the firing location of the simulated round of the precision guided munitions.

10. The apparatus as claimed in claim 4, wherein said means for determining includes a processor.

11. The apparatus as claimed in claim 1, wherein said designator device includes a laser transmitter.

12. A method for simulating effects of precision guided munitions upon a target comprising the steps of:

transmitting a mission message to a target, said mission message including a location of an impact area of said simulated precision guided munitions and a designator code;

transmitting by a designator simulator a coded signal to the target;

decoding the coded signal by a processor associated with the target to produce a decoded signal;

independently determining a location of the target;

comparing a code of the decoded signal with the code transmitted in the mission message;

comparing a firing location of the simulated precision guided munitions transmitted with the mission message with the location of the target; and displaying sensory cues if the firing location of the simulated precision guided munitions and the location of the target compare and if the decoded signal compares with the code transmitted in the mission message.

13. The method as claimed in claim 12, wherein there is further included the steps of:

identifying by an observer a target upon which to simulate the effects of the precision guided munitions;

transmitting a radio signal from the observer to a control center which indicates a call for fire of the target; and transmitting by the observer the coded signal to the target.

14. The method as claimed in claim 13, wherein there is further included the steps of:

independently determining by the target a location of the target; and detecting by the target the coded signal.

15. The method as claimed in claim 14, wherein there is further included the step of determining whether the location of the target is in a lethal area to a location of the firing location of the simulated precision guided munitions.

16. The method as claimed in claim 15, wherein there is further included the step of determining by the target whether the target is being indicated by a laser designator simulator as the target.

17. The method as claimed in claim 16, wherein there is further included the step of waiting a particular time interval to simulate a behavior of an actual precision guided munitions.

18. The method as claimed in claim 17, wherein there is further included the step of determining by the target whether the target is still being signaled by the laser designator simulator.

19. The method as claimed in claim 18, wherein there is further included the step of assessing the target a near miss if the target is not indicated by the laser designator simulator.

20. The method as claimed in claim 18, wherein there is further included the step of assessing the target a hit, if the target is indicated by the laser designator simulator.

* * * * *